US006859955B2

(12) United States Patent
Hudson

(10) Patent No.: US 6,859,955 B2
(45) Date of Patent: Mar. 1, 2005

(54) SHOWER ATTACHMENT UNIT

(76) Inventor: Thomas E. Hudson, 606 E. 177th, Belton, MO (US) 64012

( * ) Notice: Subject to any disclaimer, the term of this patent is extended or adjusted under 35 U.S.C. 154(b) by 0 days.

(21) Appl. No.: 10/696,514

(22) Filed: Oct. 29, 2003

(65) Prior Publication Data

US 2004/0083545 A1 May 6, 2004

Related U.S. Application Data

(60) Provisional application No. 60/422,297, filed on Oct. 30, 2002.

(51) Int. Cl.[7] ..... A47K 3/28; A47K 3/20

(52) U.S. Cl. ..... 4/601; 4/567; 4/615; 239/315; 239/318

(58) Field of Search ..... 4/601, 615, 567; 239/310, 315, 318

(56) References Cited

U.S. PATENT DOCUMENTS 1,220,704 A 3/1917 Swimmer
1,758,115 A * 5/1930 Kelly ..... 4/601 X
3,134,545 A 5/1964 Armond
3,761,021 A 9/1973 White
4,218,013 A 8/1980 Davison
4,281,796 A 8/1981 Fugent et al.
4,397,050 A * 8/1983 Davis et al. ..... 4/601
4,752,975 A * 6/1988 Yates ..... 4/601
4,901,927 A * 2/1990 Valdivia ..... 4/601 X
4,956,883 A 9/1990 Lane
5,353,448 A * 10/1994 Lee ..... 4/567 X
5,678,258 A * 10/1997 Healy ..... 4/601
6,079,060 A 6/2000 Walker
6,233,756 B1 5/2001 Holbrook, Sr.
6,442,775 B1 * 9/2002 Gransow et al. ..... 4/601

* cited by examiner

*Primary Examiner*—Gene Mancene
*Assistant Examiner*—Kathleen J. Prunner
(74) *Attorney, Agent, or Firm*—Chase Law Firm, L.C.

(57) ABSTRACT

A device for attachment to an existing shower water supply to provide a primary shower head for normal delivery of water during a shower and a secondary shower head for delivering an adjustable mixture of water and moisturizing lotion to the body of the user.

15 Claims, 8 Drawing Sheets

Fig. 4
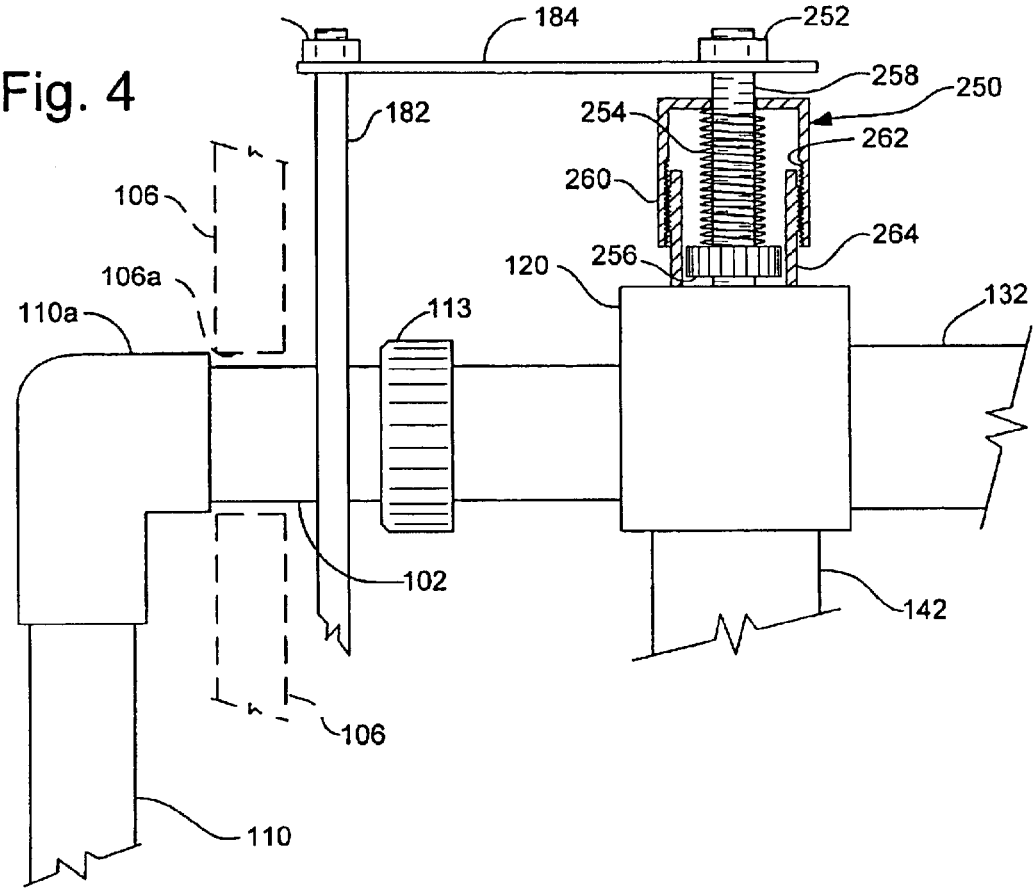
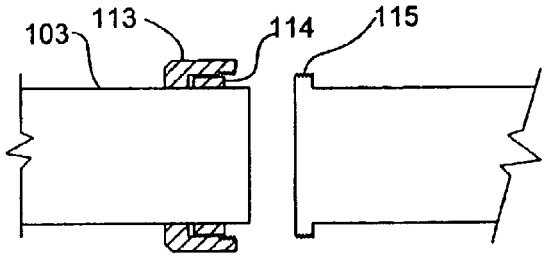
Fig. 5
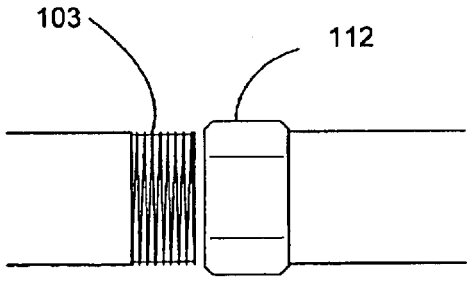
Fig. 6

SHOWER ATTACHMENT UNIT

CROSS REFERENCE TO RELATED APPLICATION

This application claims the benefit of the prior filed, co-pending provisional application Ser. No. 60/422,297, filed Oct. 30, 2002.

FIELD OF THE INVENTION

This invention relates to shower spray heads and more particularly to a device providing a secondary shower head for delivering a mixture of water and lotion to the body at the conclusion of a shower to moisturize the skin.

BACKGROUND OF THE INVENTION

During the course of a typical shower, soap, shampoo and large volumes of warm water are applied or sprayed onto the skin. Most soaps dry and irritate the skin and in combination with the warm water, rob the skin of its natural oils. This loss of natural skin moisturizers can cause or exacerbate eczema, psoriasis and other conditions. Dry skin conditions are typically worse in winter months when the relative humidity of indoor air is often extremely low. To counter the effects of dry air conditions and the drying effects of showering, many individuals apply lotion after showering and prior to getting dressed.

Devices exist in the prior art to deliver soap, shampoo or conditioner via shower heads for the convenience of the user. However, these devices typically do not deliver lotion or other moisturizers to the body during showering, while avoiding undesired application of such substances to the face and hair of the user.

BRIEF SUMMARY OF THE INVENTION

A device in accordance with the present invention includes a primary shower head for delivering water during normal shower operation, a secondary shower head for delivering a mixture of water and lotion to the body at the conclusion of the shower, a diverter valve for redirecting water from the primary shower head to the secondary shower head when application of lotion is desired, a metering valve for selecting the amount of lotion applied by the second shower head, and a means for drawing lotion from a receptacle or from a container into the water flow directed to the second shower head. An important aspect of this invention includes positioning of the second shower head so as to direct the stream of water and lotion to the body while avoiding the head and particularly the face and hair. The device is constructed so that the secondary shower head is deactivated, and the normal flow path restored, when water is turned off at the conclusion of the shower, and, so that tubing supplying water to either shower head does not retain standing water when not in use. The device thereby avoids delivering a short burst of ambient temperature water when water is diverted from the primary to the secondary shower head and will always be reset for delivery of water through the primary shower head at the next instance of use.

BRIEF DESCRIPTION OF THE DRAWINGS

FIG. 4 is an enlarged detail view of selected elements including a diverter valve coupling and an alternative reset mechanism;

FIG. 5 is a partial cross sectional view of the diverter valve coupling shown in FIG. 4;

FIG. 6 is an enlarged view of the diverter valve coupling shown in FIG. 1;

DETAILED DESCRIPTION

Figure 1:
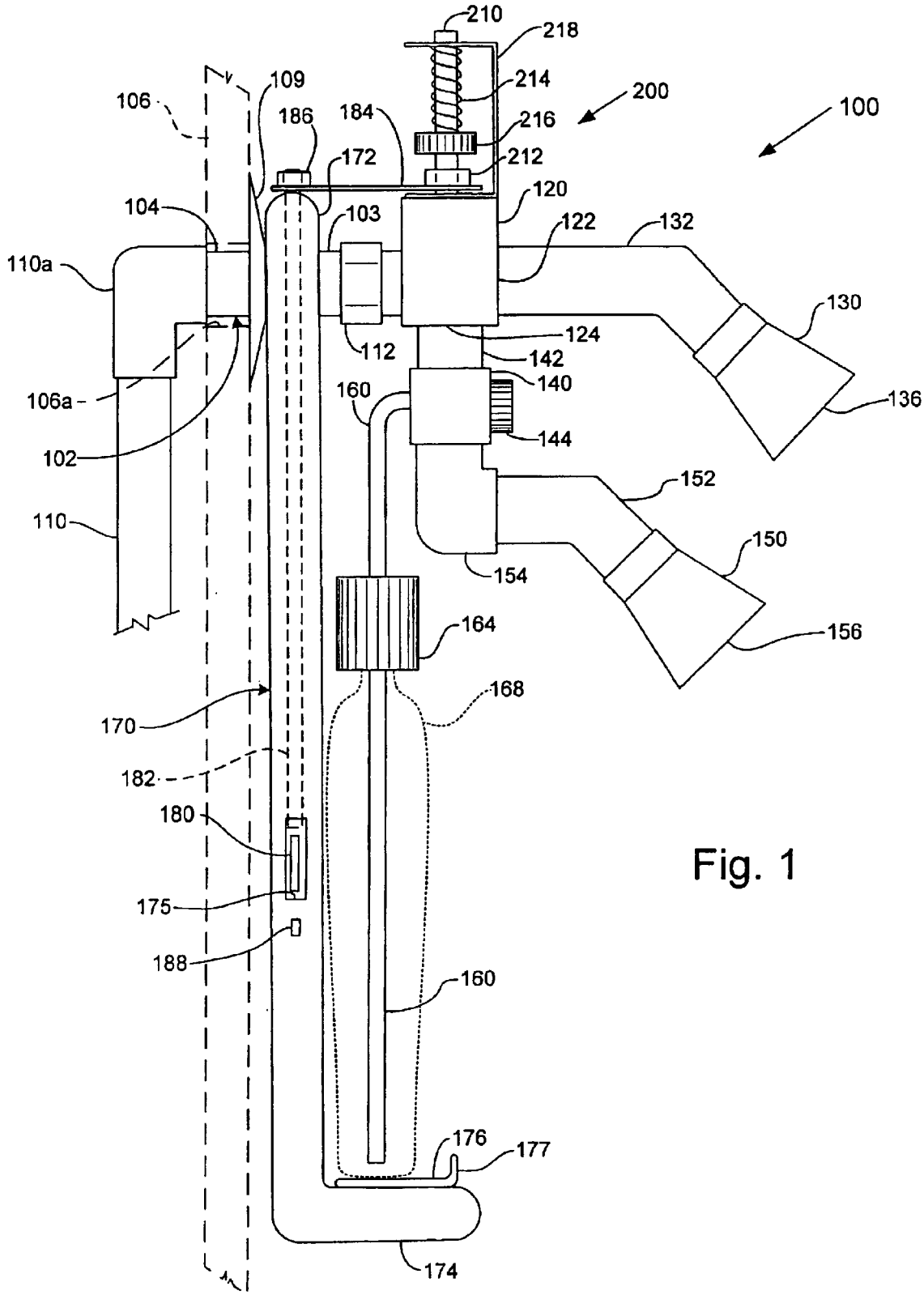
FIG. 1 is a side elevational view of a shower attachment unit in accordance with the present invention.

Turning to a detailed description of the drawings, FIG. 1 illustrates a shower attachment unit 100 in accordance with the present invention including an inlet pipe 102 having threads at both proximate 103 and distal 104 ends and adapted to couple at the distal end 104 by threaded means to a conventional shower supply pipe or riser 110. The riser 110 may by provided with an elbow 110*a* for directing a female, threaded opening toward an access hole 106*a* in the shower wall 106 (shown in phantom lines). The riser 110 is typically located behind the wall 106 of a shower and is typically connected to conventional plumbing fixtures (not shown) that provide a selected mixture of cold and hot water. In the open-frame embodiment shown in FIG. 1, an escutcheon 109 may be used to surround the inlet pipe 102 and cover the access hole 106*a*.

The proximate end 103 of the inlet pipe 102 is removably connected to a diverter valve coupling 112 which joins the inlet pipe 102 in fluid communication to a diverter valve 120. In its resting state, the diverter valve 120 allows water to pass from the inlet pipe 102 through the body of the diverter valve 120, then through a primary diverter valve outlet 122 to a primary shower head 130, and then exit through the face 136 of the shower head 130. The shower head typically already in place prior to installation of the device of the present invention 100 may be selected for use as the primary shower head 130. Typically, the selected primary shower head 130 is connected to the diverter valve 120 via a primary shower head connection pipe 132. When the diverter valve 120 is in its resting position, the primary shower head 130 functions as a conventional shower head providing only water to the body of the user.

In addition to the inlet pipe 102 and the primary shower head 130, a metering valve 140 is also in fluid communication with the diverter valve 120 through a secondary diverter valve outlet 124. A pipe 142 or other suitable device may be used to connect the metering valve 140 to the diverter valve 120. When the diverter valve 120 is in its activated state, water is diverted within the body of the valve 120 from flowing through the primary outlet 122 to the primary shower head 130, to flow instead through the secondary outlet 124 to the metering valve 140, and thence to a secondary shower head 150. The secondary shower head 150 should be constructed so as to minimize creation of back pressure. More particularly, the secondary shower head 150 should not include flow restriction structures as used in reduced flow shower heads. As with connector 132, one or more connectors (152 and 154) may be used to fluidly connect the secondary shower head 150 to the metering valve 140.

A supply tube 160 fluidly connects to the metering valve 140 so that when water flows through the metering valve 140 from the diverter valve 120 to the secondary shower head 150 a venturi effect is created causing a vacuum to be applied to the supply tube 160. The supply tube 160 projects downwardly from the metering valve 140 through a cap 164 and into a selected fluid reservoir such as a bottle of body lotion 168 (shown in phantom lines). Appropriate lotions include those containing humectants such as glycerin as hydrating agents for increasing water absorption by the skin surface.

Figure 2:
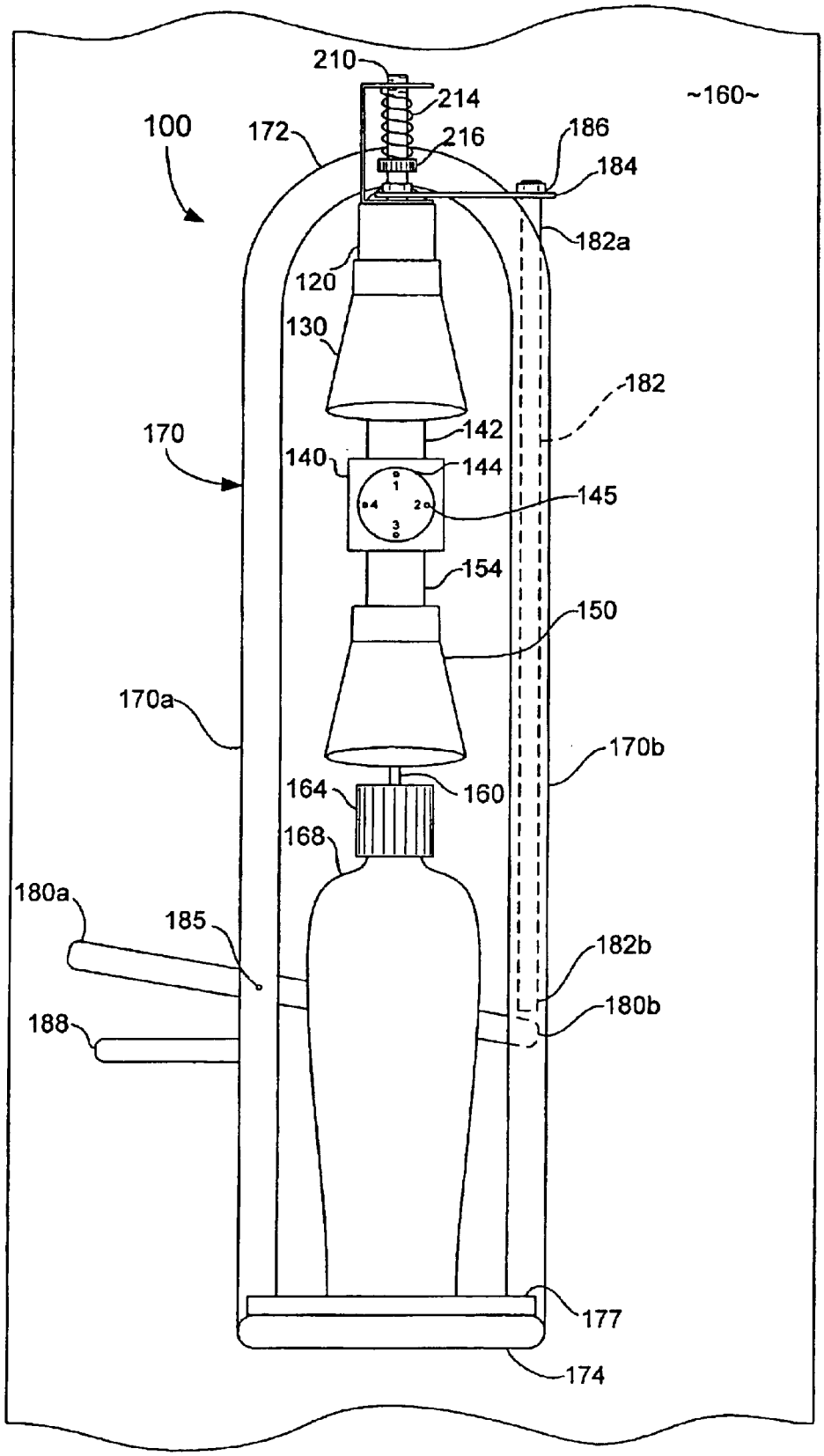
FIG. 2 is a front view of the shower attachment unit of FIG. 1.

A means for holding the lotion bottle 168 in position is provided by a rack 170 or other suitable device. In FIGS. 1 and 2, the rack 170 is shown as being comprised of tubular plastic including a upper portion 172 bent in a U-shape to rest upon the inlet pipe 102 and a lower portion bent outwardly and horizontally to form a support ledge 174 for a bottle shelf 176. As shown, the bottle shelf 176 includes a vertically projecting lip 177 for further retaining the lotion bottle 168.

In addition to holding the lotion bottle 168, the rack 170 also provides an attachment point and housing for an operating lever 180. The operating lever 180 is used to activate the diverter valve 120. As shown in FIGS. 1 and 2, the operating lever 180 is connected to the diverter valve 120 via primary 182 and secondary 184 arms.

The diverter valve 120 shown in FIGS. 1 and 2, is controlled by a spring bias device 200 used to hold the diverter valve 120 in a selected resting or activated state. When in the resting state, as shown in FIGS. 1 and 2, the diverter valve 120 provides a normal flow of water to the primary shower head 130. Upon downward motion of the operation lever 180, the primary connecting arm 182 is raised. This upward motion is transferred to the secondary connecting arm 184 which raises a diverter valve shaft 210 via upward pressure on nut 212 fixed to the shaft 210 and located above the secondary connecting arm 184. Resistance to this upward motion of the shaft 210 is provided by biasing spring 214 which exerts a pressure against flange 218 and a tension adjustment nut 216 that tends to drive shaft 210 downward. Downward motion of the shaft 210 returns the diverter valve 120 to the resting state.

Figure 10:
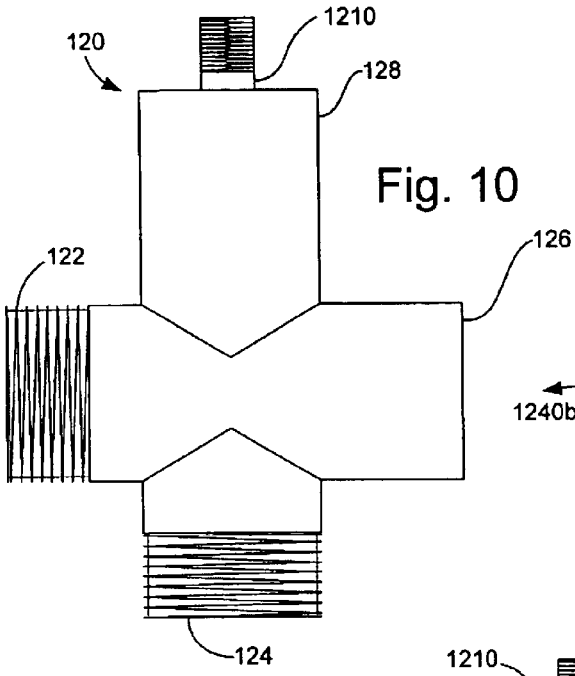
FIG. 10 is an enlarged view of a diverter valve.
Figure 11:
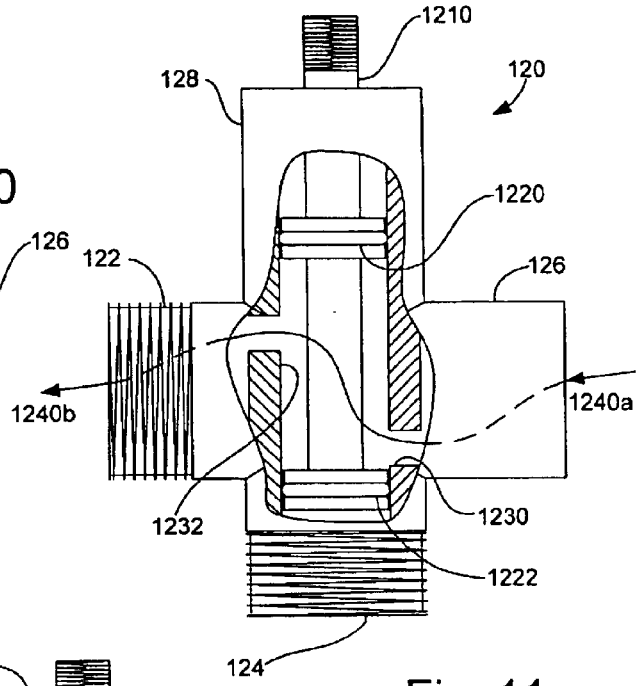
FIG. 11 is a breakaway and partial cross sectional view of the diverter valve of FIG. 10 showing the fluid flow path to the primary shower head.
Figure 12:
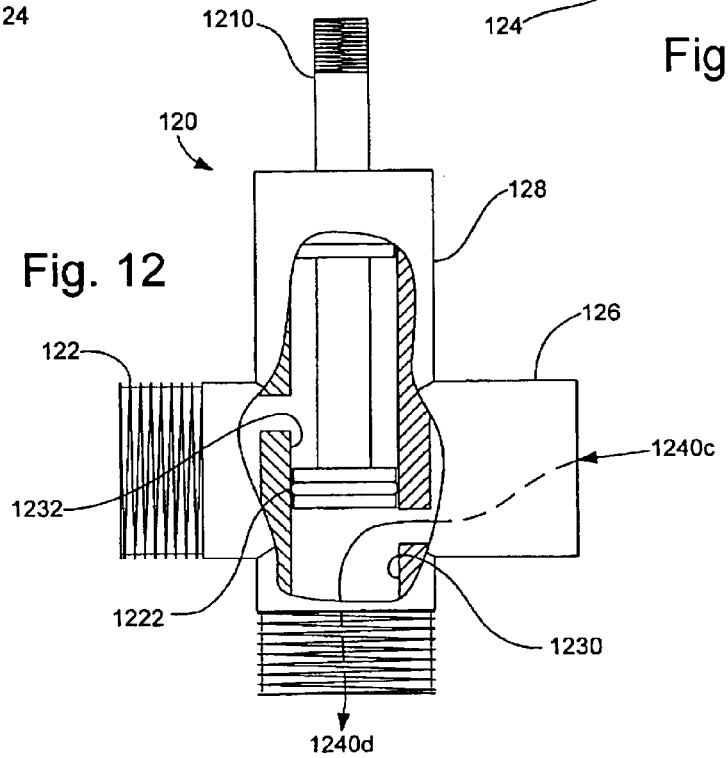
FIG. 12 is a breakaway and partial cross sectional view of the diverter valve of FIG. 10 showing the fluid flow path to the secondary shower head.

FIGS. 10–12 illustrate an embodiment of a diverter valve 120 that may be used to practice the present invention. FIG. 10 is a side elevational view of the diverter valve 120 showing the diverter valve inlet 126, primary outlet 122, secondary outlet 124 and activation channel 128. FIGS. 11 and 12 illustrate the interior of the diverter valve 120 of FIG. 10 in resting and activated states respectively. Shaft 210, as illustrated in FIG. 1, is connected to a plunger 1210 located within the valve 120. The plunger 1210 includes two spaced plunger gaskets 1220 and 1222, referred to herein as the upper gasket 1220 and lower gasket 1222.

When the plunger 1210 is in a lowered position (see FIG. 11), the diverter valve 120 is in the resting state. When in the diverter valve 120 is in the resting state, a seal formed between the lower gasket 1222 and inlet baffle 1230 directs water to the primary shower head 130, via the primary exit 122, and prevents water from entering the secondary exit 124. Arrows 1240*a* and 1240*b* indicate the flow path of water through the diverter valve 120 when the valve is in the resting state.

When the plunger 1210 is in a raised position (see FIG. 12), the diverter valve 120 is in the activated state, and a seal formed between the lower gasket 1222 and outlet baffle 1232 sends water to the secondary shower head 150, via the secondary outlet 124. Arrows 1240*c* and 1240*d* indicate the flow path of water through the diverter valve 120 when the valve is in the activated state. In both the resting and activated states, the upper gasket 1220 prevents water from exiting upward through the activation channel 128.

When the plunger 1210 is raised and the valve 120 is in activated state water pressure is exerted against the lower gasket 1222, overcoming resistance provided by the biasing spring 214, and retaining the valve 120 in an activated state even after downward pressure on 180 is released.

Upon shutting off the flow of water to the shower riser 110, water pressure within the diverter valve 120 no longer pushes against the biasing spring 214 and, therefore, the biasing spring 214 is able to return the diverting valve 120 to its resting position. Alternatively, normal operation of the diverter valve 120 may be restored by raising the operation lever 180, thereby manually setting the diverter valve 120 to the resting position. As shown in FIGS. 1 and 2, the biasing spring 214 exerts a force tending to cause the diverter valve 120 to rest in a non-activated state. It is important to the function of the device that the tension applied by the biasing spring 214 be overcome by the system water pressure. Due to differences in water pressure from region to region or house to house, an adjustment knob 216 may be used so that the tension of the biasing spring 214 may be manually adjusted.

When water is diverted to the metering valve 140 it passes through the valve to the secondary shower head 150 causing a venturi effect and applying vacuum to the supply tube 160. In order to vary the amount of lotion drawn by vacuum from the lotion bottle 168 through the supply tube 160 to the metering valve 140, the metering valve used should include an adjustment mechanism for varying the amount of vacuum. As illustrated in FIG. 2, the metering valve 140 includes vacuum release apertures 145. Although not shown in FIG. 2, these apertures 145 are of varying diameters. By turning metering valve knob 144, a selected aperture 145 may be exposed allowing air to enter the valve 140, through the aperture 145, thereby reducing the vacuum applied to supply tube 160 and the rate at which fluid is drawn from bottle 168.

Figure 3:
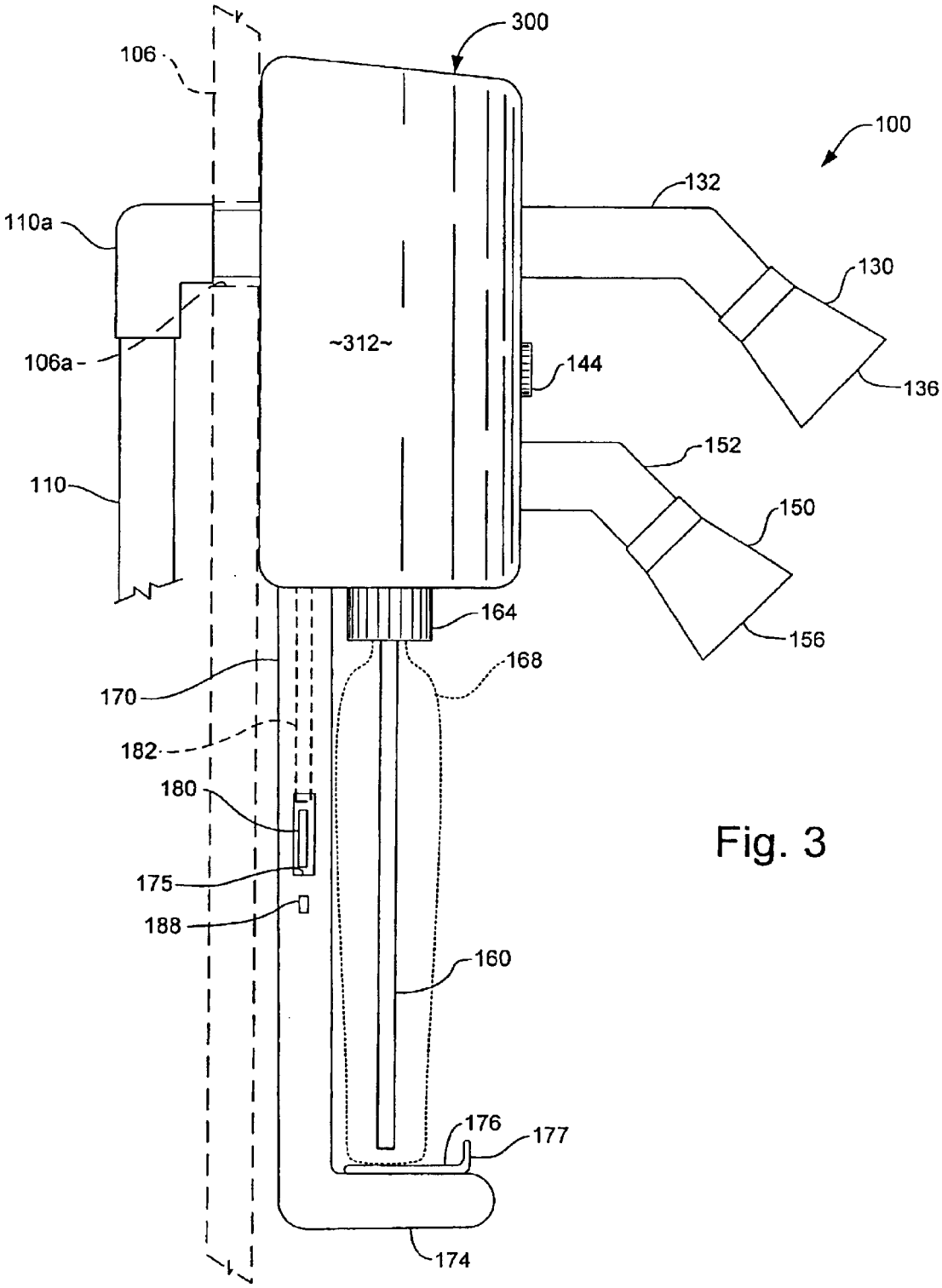
FIG. 3 is a side elevational view of an alternative embodiment of the device of FIGS. 1 and 2 including a removable cover.

The embodiment shown in FIG. 3 includes a cover 300 that rests against the shower wall 106, rendering use of an escutcheon 109 unnecessary.

FIG. 4 illustrates an alternative diverter valve coupling 113 and an alternative reset mechanism 250. The reset mechanism 250 includes a diverter valve shaft 258 projecting from the top of an associated diverter valve 120, an outer barrel 260 threadably engaged to an inner barrel 264, a spring 254 surrounding shaft 258, and adjustment nut 256 threadably engaged to shaft 258. As illustrated, inner barrel 264 is fixed to the upper surface of diverter valve 120. When primary connecting arm 182 is raised upon engagement of the device via lever 180, upward motion is transferred to secondary connecting arm 184 raising diverter valve shaft 258. Resistance to the upward motion of shaft 258 is provided by biasing spring 254, which exerts pressure against outer barrel 260 and adjustment nut 256. Adjustment nut 256 may be moved rotatably upwards or downwards along shaft 258 to increase or decrease resistance, respectively, to the upward movement of shaft 258. Alternatively, the resistance provided by spring 254 may be adjusted by rotating outer barrel 260 about inner barrel 264 via threads 262, thereby compressing or releasing spring 254.

FIG. 5 is a partial cross sectional view of the diverter valve coupling shown in FIG. 4 showing threaded flange 115 at the end of a diverter valve 120 inlet and compression ring 114 which, when tightened against flange 115 by screwing compression fitting 113 onto flange 115, causes a water-tight seal to form between tube 102 and the diverter valve 120 inlet.

FIG. 6 is an enlarged view of the threaded diverter valve coupling shown in FIG. 1. In this embodiment the ends of tube 102 and the diverter valve inlet are sealed by a gasket (not shown) housed within compression nut 112. When compression nut 112 is threaded onto the threaded end 103 of tube 102, the tube 102 and the diverter valve inlet are drawn together and against the gasket, thereby forming a water tight seal. It should be appreciated that functional equivalents of the mechanisms shown in FIGS. 4–6 may be used.

Figure 7:
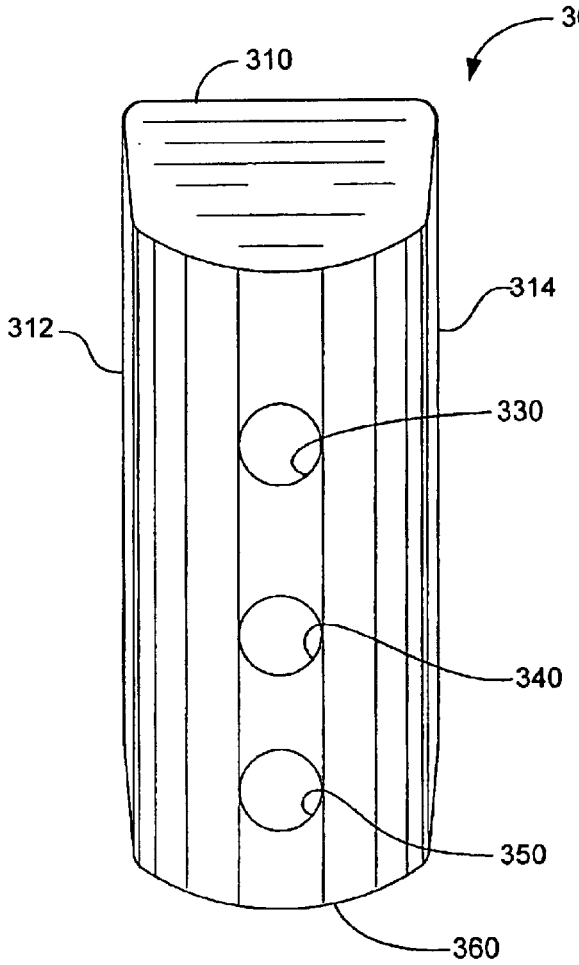
FIG. 7 is an enlarged, front, downward perspective view of the cover shown in FIG. 3.
Figure 8:
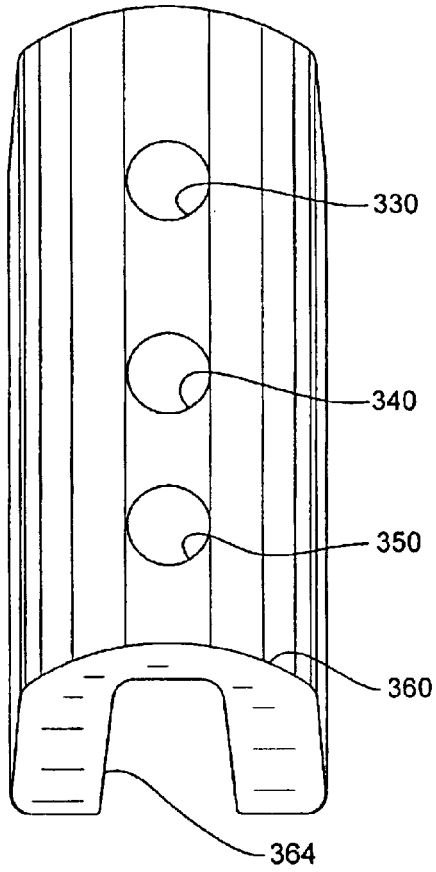
FIG. 8 is an enlarged, front, upward perspective view of the cover of FIG. 7.

FIG. 7 is an enlarged, front, downward perspective view of the cover 300 shown in FIG. 3 showing a top surface 310, left 312, and right 314 sides, and a front surface including three holes 330, 340 and 350 for accommodating the protrusion of the primary shower head 130, metering valve knob 144, and secondary shower head 150, respectively, through the front surface of the cover (see also FIGS. 1 and 3). FIG. 8 is an enlarged, front, upward perspective view of the cover of FIG. 7 showing the side and front surfaces of FIG. 7 and also a bottom surface 360 including a notch 364 for providing space for the supply tube 160 and the bottle cap 164.

Figure 9:
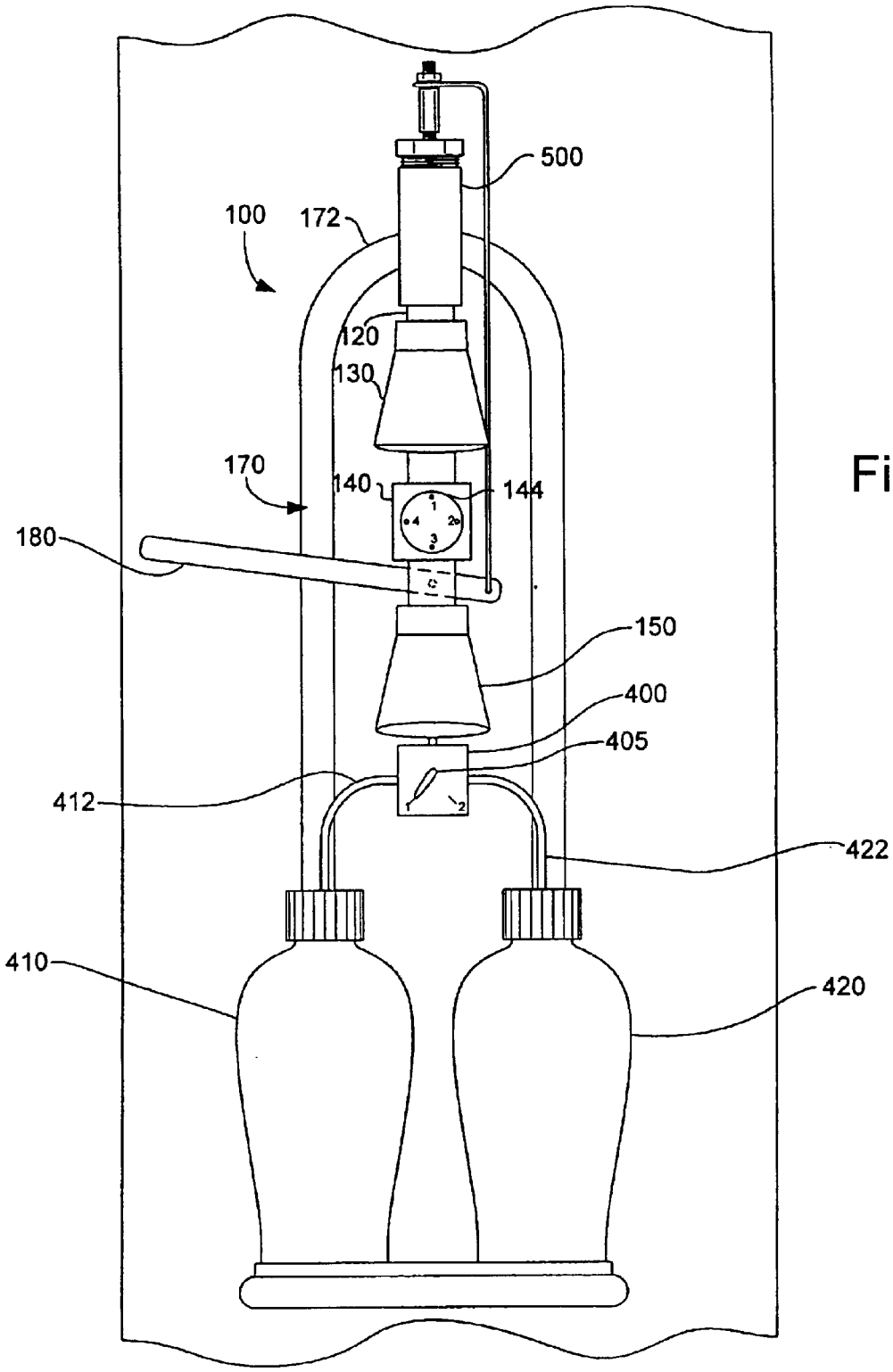
FIG. 9 is a front elevation of another alternative embodiment including means for selecting from a plurality of fluid reservoirs.

FIG. 9 is a front elevation of an alternative embodiment including means for selecting from a plurality of fluid reservoirs (e.g. 410 and 420). As illustrated, supply tube 160, depending from metering valve 140 is in further fluid communication with a switching valve 400, commonly known in the art and typically operated via a switching lever or knob 405. The switching valve 400 is provided so that an operator may select one of two differing fluids, as required for specific conditions, for application to the body through the secondary shower head 150. Differing fluids may include lotions of differing scents, medication properties, or humectant properties. When the switching valve 400 is selected to position 1, for example, fluid from bottle 410 is drawn via venturi action through associated tube 412 into switching valve 400 and then through supply tube 160 where it continues through to the metering valve 140 and exits through the secondary shower head 150 along with the stream of water. FIG. 9 also illustrates an optional position for the lever 180 on the rear of the metering valve 140.

Figure 13:
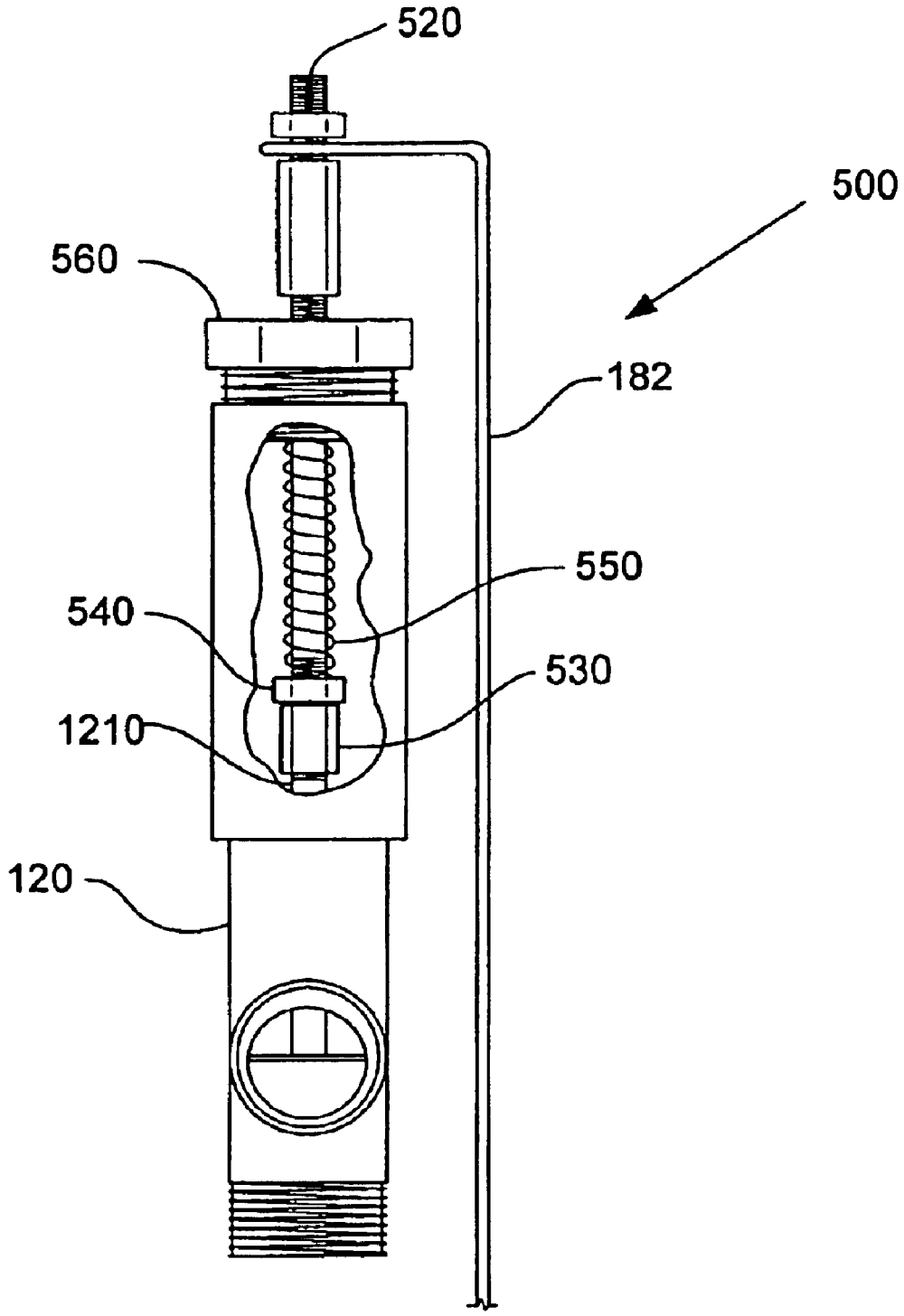
FIG. 13 is a breakaway view of the reset mechanism of FIG. 9.

An alternative embodiment 500 of the reset mechanism is also shown in FIG. 9 and is illustrated in further detail in FIG. 13. As illustrated in FIGS. 9 and 13, this embodiment of a reset mechanism includes a shaft and biasing spring mechanism similar to that illustrated in FIG. 1, housed in a sleeve 510. Turning more particularly to FIG. 13, the reset mechanism 500 is mounted the top of the diverter valve 120. The diverter valve plunger 1210 is connected to a reset mechanism shaft 520 via a coupler 530. Alternatively, plunger 1210 may be constructed in an elongated form to incorporate the structure of shaft 520. A tension adjustment nut 540 is threadably mounted on shaft 520 for providing a means of adjusting the compression of biasing spring 550. A sleeve cap 560 is threadably engaged, or otherwise mounted, to a top portion of the sleeve 510. The shaft 520 projects upward through the cap 560 and is engaged to a connecting arm 182 which is raised in the manner described above via lever 180.

It is to be understood that while certain forms of this invention have been illustrated and described, it is not limited thereto except insofar as such limitations are included in the following claims and allowable equivalents thereof.

Having thus described the invention, what is claimed as new and desired to be secured by Letters Patent is as follows:

1. A shower attachment unit comprising:

an upper shower head in communication with a water supply line, a lower shower head in communication with a fluid reservoir, and means for selectively diverting water from said upper shower head to said lower shower head whereby fluid is drawn from said reservoir into said lower shower head.

2. The shower attachment unit of claim 1 wherein said lower shower head is positioned to deliver fluid from said reservoir to the body of the user while substantially avoiding the head of the user.

3. The shower attachment unit of claim 1 wherein said fluid is selected from the group consisting of lotion, moisturizer, medication and humectant.

4. The shower attachment unit of claim 1 wherein said means for diverting comprises a diverter valve having a first position for supplying water to said upper shower head and a second position for supplying water to said lower shower head.

5. The shower attachment unit of claim 4 further comprising means under operator control for switching said diverter valve between said first position and said second position.

6. The shower attachment unit of claim 4 wherein said diverter valve returns to said first position when the supply of water to said shower attachment unit is halted.

7. The shower attachment unit of claim 4 wherein said diverter valve includes a reset mechanism for returning said diverter valve to said first position from said second position upon reduction of water pressure beyond a selected limit.

8. The shower attachment unit of claim 4 further comprising a metering valve in fluid communication with said diverter valve, said lower shower head in fluid communication with said metering valve so as to receive water delivered to said metering valve when said diverter valve is in said second position.

9. The shower attachment unit of claim 8 further comprising means for drawing fluid from said reservoir into said metering valve.

10. The shower attachment unit of claim 9 wherein said means for drawing comprises a vacuum created by venturi effect caused by flow of water to said lower shower head.

11. The shower attachment unit of claim 8 wherein said metering valve comprises means for varying the rate of fluid flow from said reservoir.

12. The shower attachment unit of claim 11 wherein said means for varying comprises vacuum release apertures.

13. The shower attachment unit of claim 1 further comprising means for selecting from a plurality of said fluid reservoirs.

14. The shower attachment unit of claim 13 wherein said means for selecting comprises a switching valve.

15. A shower attachment unit comprising:

a primary shower head in fluid communication with a diverter valve, said diverter valve in fluid communication with a shower riser, whereby said primary shower head receives water from said shower riser through said diverter valve when said diverter valve is in a first position, a metering valve in fluid communication with said diverter valve so as to receive water from said riser when said diverter valve is in a second position, a secondary shower head in fluid communication with said metering valve so as to receive water delivered to said metering valve, a tube having a proximate and a distal end, said proximate end in fluid communication with said metering valve and attached to said metering valve so that when water is received by said metering valve from said diverter valve and delivered to said secondary shower head, a venturi effect is created causing a vacuum upon said tube at said proximate end causing fluid to be drawn into said tube at said distal end, said metering valve including means for increasing or decreasing the vacuum applied to said tube, said diverter valve including means for activation whereupon activation of said diverter valve water provided by said riser is substantially diverted from said primary shower head to said metering valve and then to said secondary shower head.

* * * * *